US006846228B2

(12) United States Patent
Lin

(10) Patent No.: US 6,846,228 B2
(45) Date of Patent: Jan. 25, 2005

(54) STRUCTURE FOR A POLISHING MACHINE OF AN OPTICAL DISK

(76) Inventor: Ming-Sheng Lin, PO Box 82-144, Taipei (TW)

( * ) Notice: Subject to any disclaimer, the term of this patent is extended or adjusted under 35 U.S.C. 154(b) by 66 days.

(21) Appl. No.: 10/206,082

(22) Filed: Jul. 29, 2002

(65) Prior Publication Data

US 2004/0029504 A1 Feb. 12, 2004

(51) Int. Cl.[7] ..... B24B 5/00

(52) U.S. Cl. ..... 451/290; 451/269; 451/268; 451/359; 451/263; 451/456; 15/21

(58) Field of Search ..... 451/290, 269, 451/268, 359, 63, 285, 456; 15/21

(56) References Cited

U.S. PATENT DOCUMENTS 4,561,142 A * 12/1985 Mischenko et al. ..... 15/97.1
5,938,510 A * 8/1999 Takahashi et al. ..... 451/290
6,116,987 A * 9/2000 Kubo ..... 451/41
6,312,320 B2 * 11/2001 Sato et al. ..... 451/285

* cited by examiner

*Primary Examiner*—Lee D. Wilson
*Assistant Examiner*—Alvin J Grant
(74) *Attorney, Agent, or Firm*—Leong C. Lei

(57) ABSTRACT

A structure for a polishing machine of an optical disk, which comprises a motor, a turntable unit integrated with a housing, at least two polishing wheel positioned on a cover which can cover up the housing, and a timer. When the cover is closed, the polishing wheel can polish the optical disk. The primary objective of this invention is to provide a structure for a polishing machine with a precise polishing effect and higher automation to increase the quality of polishing. The secondary objective of the present invention is to provide a structure for a polishing machine which is simplified in structure, miniaturize in volume and is easily stored and used.

1 Claim, 5 Drawing Sheets

STRUCTURE FOR A POLISHING MACHINE OF AN OPTICAL DISK

BACKGROUND OF THE INVENTION

1. Field of the Invention

The present invention relates to an improved structure for a polishing machine, more particularly to an improved structure for a polishing machine of an optical disk with an enhanced efficiency.

2. Description of the Prior Art

The optical disk is widely used at present. Since the optical disk can be used to store large amounts of video data and digital data, it is commonly applied to such storage media as CD-ROM, Music-CD, VCD and DVD. In order to keep the optical disk in a better state of use, it is necessary to keep the reading surface of the optical disk smooth. Since the reading surface of the optical disk is a transparent plastic surface without protective capability, it is easy to scratch the reading surface during moving and placing of the optical disk. Contamination and scratches on the reading surface will affect the result negatively during the reading of the data, therefore it is necessary to perform a suitable cleaning process on the reading surface.

A simple cleaning process only uses a paper or a cloth to wipe the plastic surface directly. However, this process is time-consuming and requires some vigor, and does not have a good result. Additionally, when there is over-wiping, or an abrasive paper and cloth is used in the cleaning process, more scratches will occur on the, plastic surface. As shown in FIG. 1, a polishing machine for an optical disk is developed according to the prior art. The polishing machine places the optical disk on a turntable (A) which can rotate freely, presses down a bar (B) on the stand of the polishing machine to make the turntable move up, and uses a polishing pad on a motor (C) to polish the optical disk. This motorized polishing machine can substantially reduce the time and vigor required. However, the abovementioned polishing machine for the optical disk possesses the following problems:

1. The size of the prior art polishing machine is too large to be stored and carried.
2. In order to ensure that the wiping range of the polishing pad covers the entire data zone of the optical disk, a bigger polishing pad, which increases the polishing time, is used.
3. The polishing time can only be estimated approximately during the operating of the polishing machine, therefore over polishing commonly occurred and causes the optical disk to be damaged permanently while the polishing machine is being operated, therefore over-polishing often occurs causing permanent damage to the optical disk.

SUMMARY OF THE INVENTION

The present invention is related to an improved structure for a polishing machine of an optical disk. The primary objective of the present invention is to provide a structure for a polishing machine with a precise polishing effect and higher automation to increase the quality of polishing.

The primary objective of the present invention is to provide a structure for a polishing machine which is simplified in structure, miniature in volume and easy to store and use.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
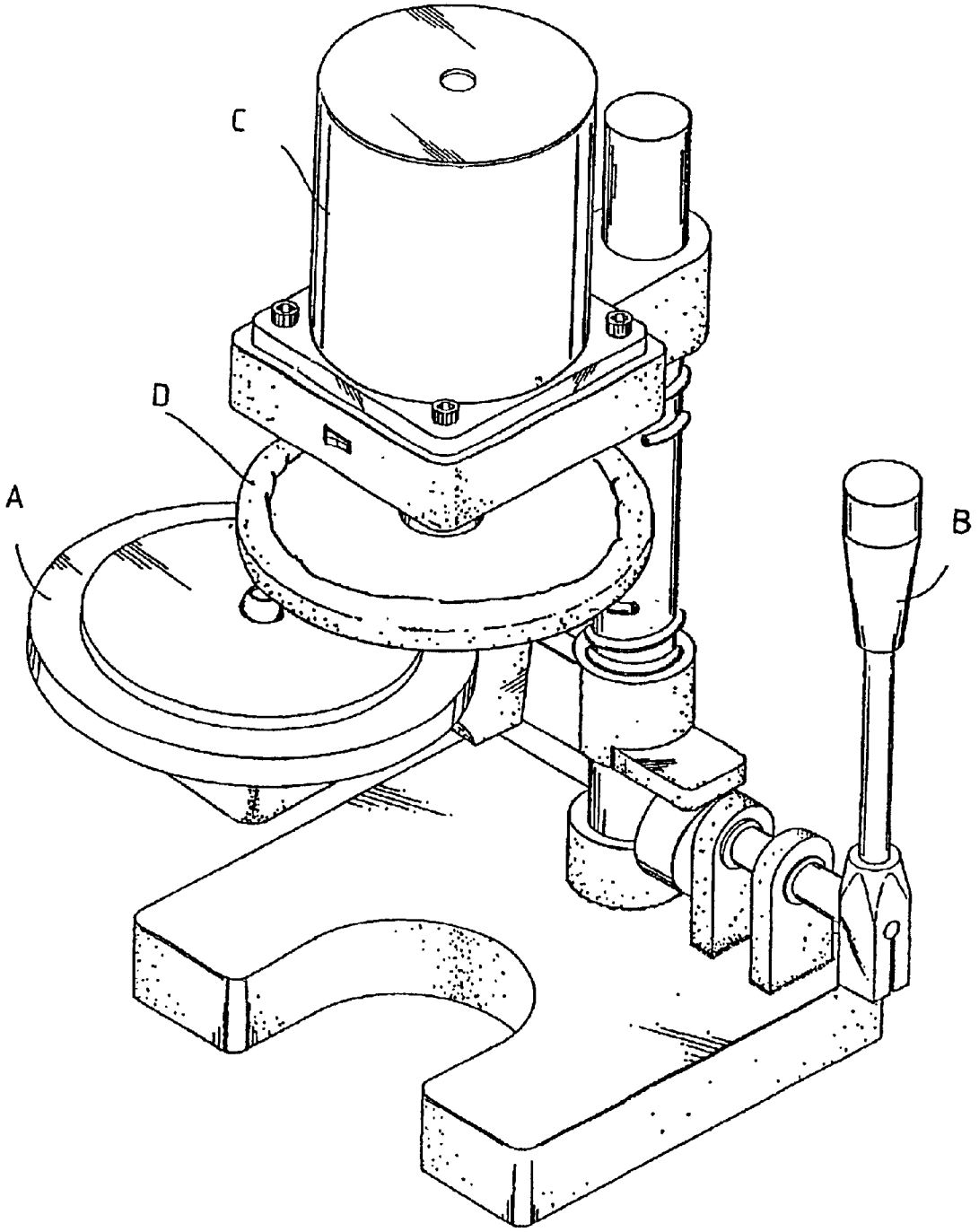
PRIOR ART FIG. 1
FIG. 1 is a three-dimensional perspective diagram of the polishing machine for an optical disk according to the prior art.
Figure 2:
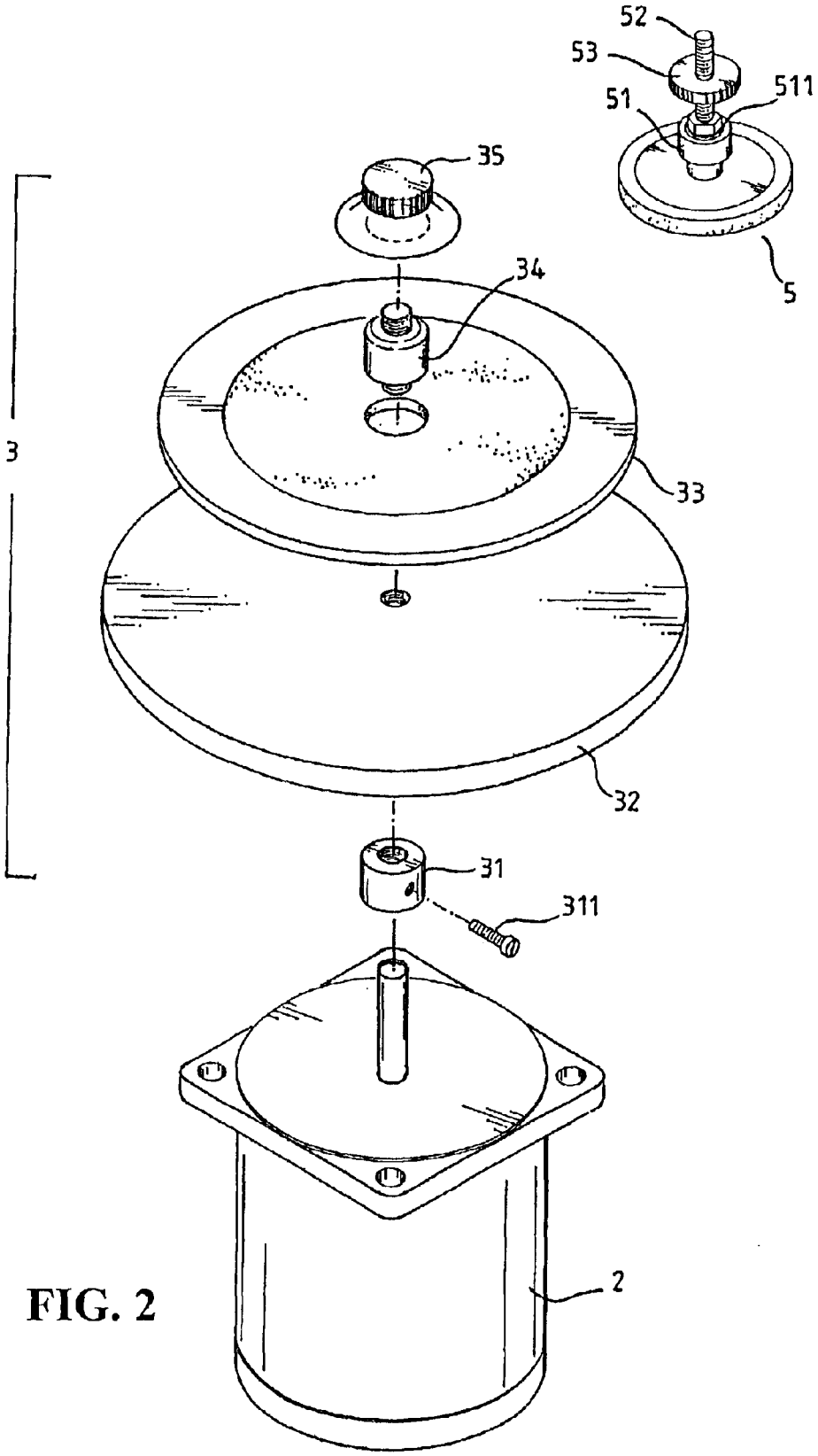
FIG. 2 is a three-dimensional decomposing diagram of the main component according to the present invention.
Figure 3:
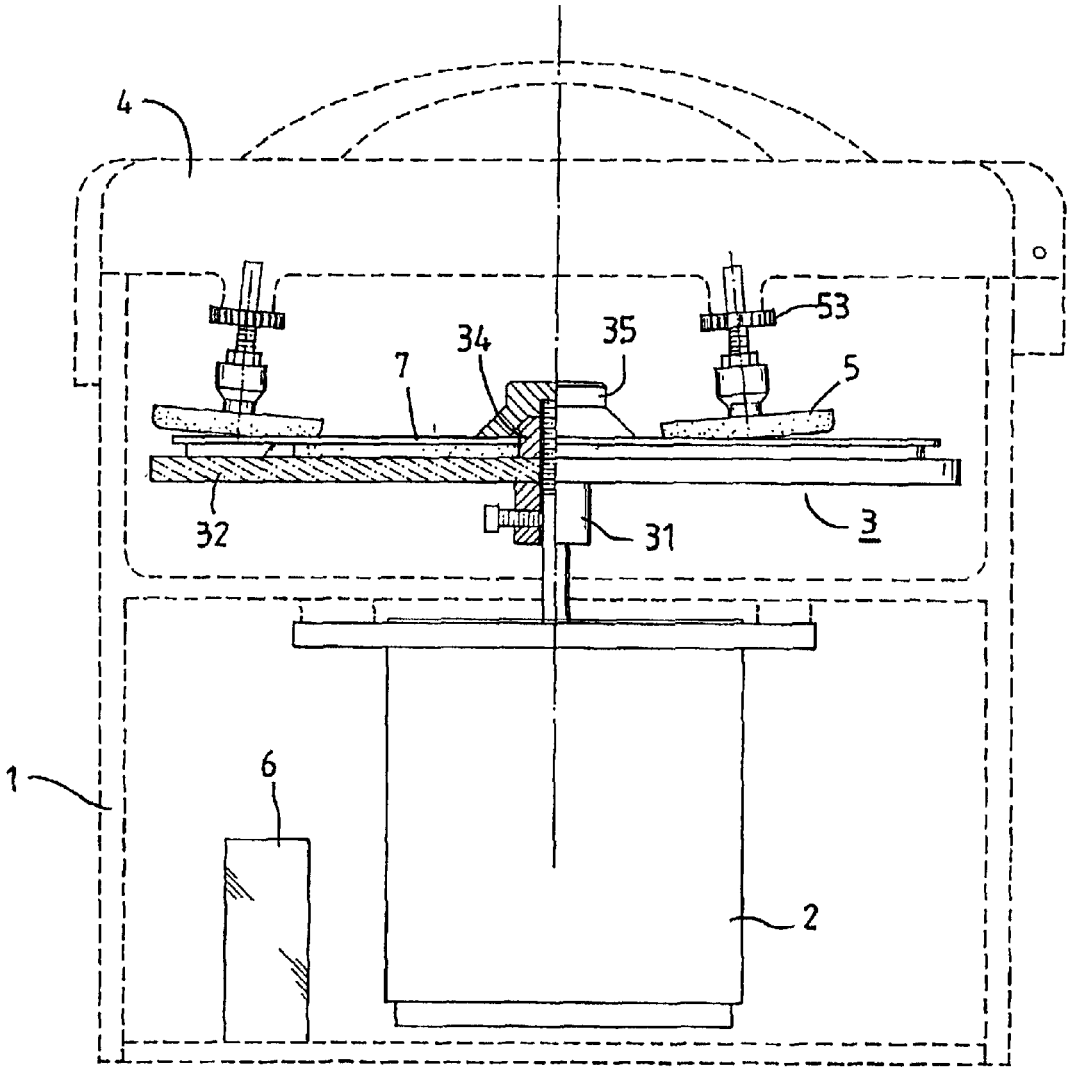
FIG. 3 is a structural plane diagram according to the present invention.

Please refer to FIG. 2 and FIG. 3. The present invention is related to an improved structure for a polishing machine of an optical disk, which comprises a motor (2), a turntable unit (3) integrated with a housing (1), at least two polishing wheels (5) positioned on a cover which can cover the housing (1), and a timer (6).

The motor (2) is fixed in the hollow housing with a predetermined strength, the turntable unit (3) is fixed at the front of the spindle of the motor, the turntable unit (3) comprises a fixing ring (31), a circular supporting plate (32), a buffer pad (33), a positioning button (34), and a nut cover (35). The fixing ring (31) is fixed on an appropriate position at the front end of the spindle of the motor by a screw (311). The circular supporting plate (32) with a predetermined strength and the soft buffer pad (33) are positioned above the fixing ring (31) in series by the positioning button (34) with a screw bar at both ends. A nut cover (35) with turning-over bowl shape and screw inside is screwed on the positioning button (34) to fix the optical disk on the buffer pad.

Please refer to FIG. 2 and FIG. 3. The polishing wheel (5) is the main component to contact the disk surface directly to perform a clean process. A spindle shaft (511) is positioned in a base (51) of the polishing wheel (5), a screw bar (52) and a screw ring (53) extended positioned in the center of the spindle shaft (511) on the cover (4) by tight screwing of the screw bar (52). The screw ring (53) is tightly fastened to enhance the fixity of the polishing wheel (5) and make it freely rotatable. The surface of one of the polishing wheels (5) presses on the data zone and covers the inner half region of the optical disk. The surface of the other polishing wheel (5) covers the outer half region and the abovementioned cover (4) can cover components of the housing (1) that can at least exchange the optical disk when opened and can fix the components when closed.

A timer (6) is connected to the power circuit of the motor in series to stop the motor when the motor is rotated for a predetermined time so as to precisely control the polishing time of the optical disk.

Figure 4:
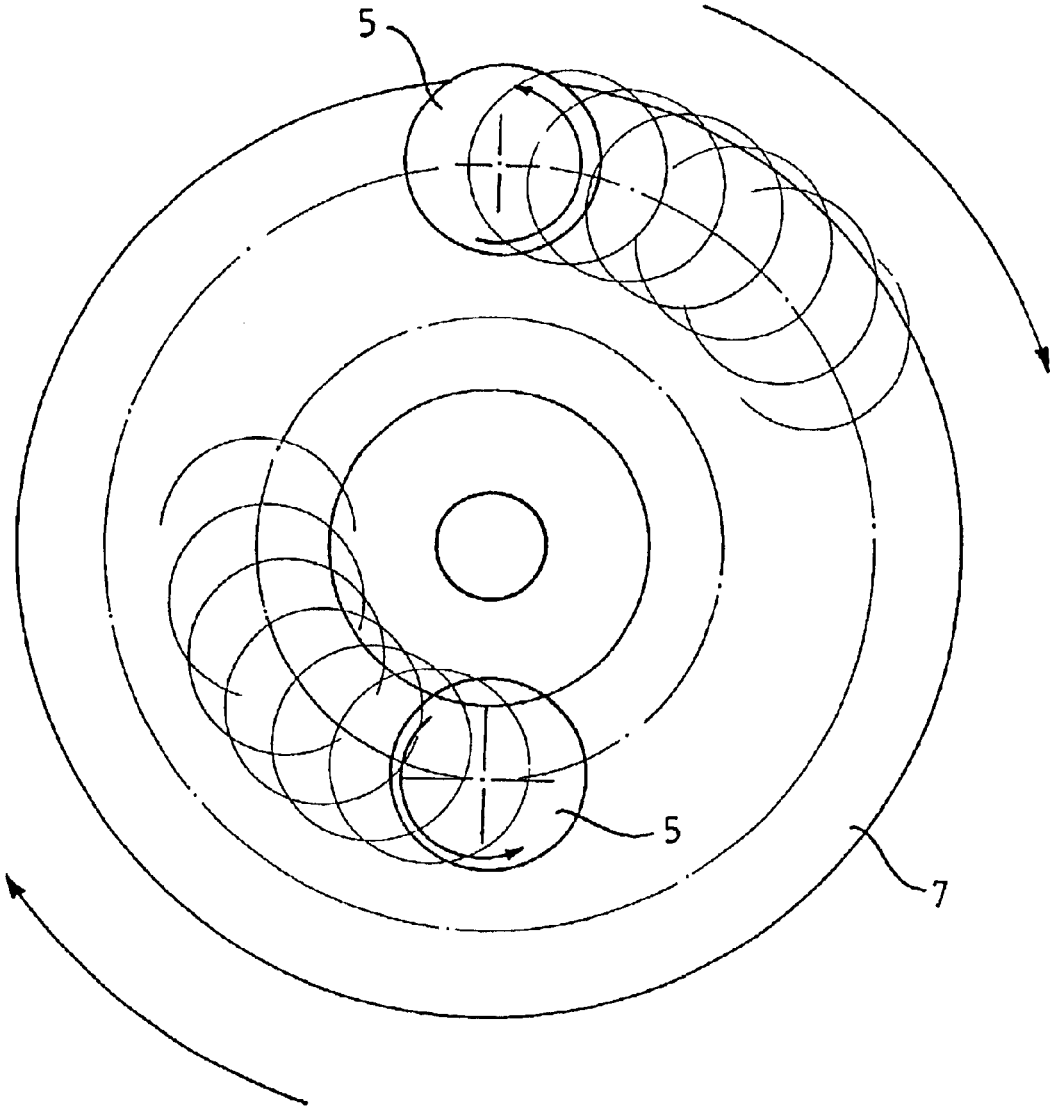
FIG. 4 is a diagram showing the wiping and polishing according to the present invention.

Once the present invention is fabricated by assembling the abovementioned components, the exchange of the optical disk is simply performed by disassembling the nut cover (35) and the optical disk can be fixed by fastening the nut cover (35) later. When the cover (4) covers the housing (1), the two polishing wheels (5) are installed exactly at the abovementioned suitable position. The motor is turned on to rotate the turntable unit (3) and a suitable amount of is then added in coordination, the two polishing wheels (5) move parabolically (see FIG. 4) to polish the surface of the optical disk, and the polishing and repairing of the plastic surface of a plastic disk is completed. Once the set time of the timer is reached, the power or the motor is turned off and the polishing is completed.

Figure 5:
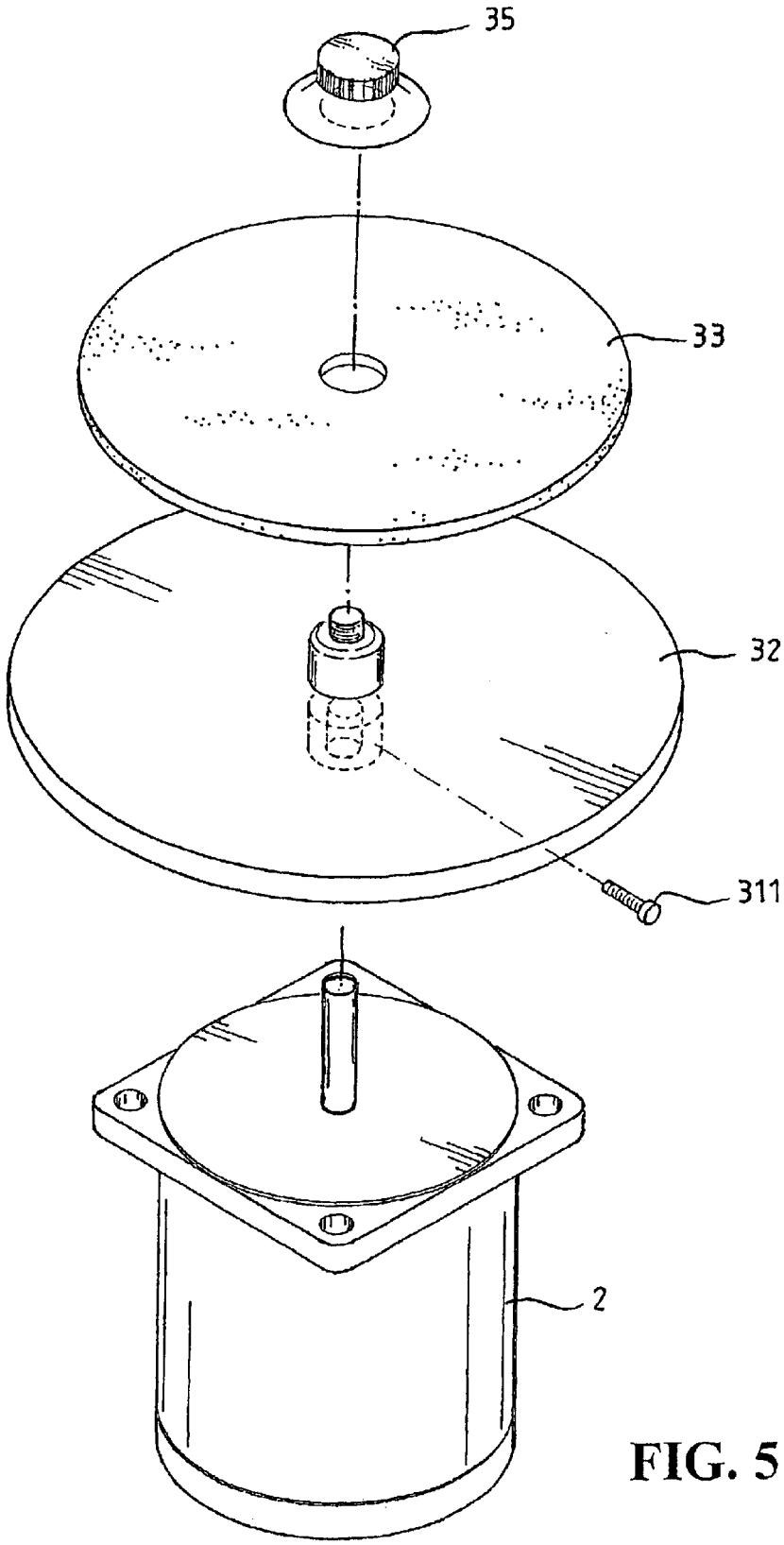
FIG. 5 is a three-dimensional decomposing diagram according to another embodiment of the present invention.

In order to satisfy the demand of mass production, the above-mentioned fixing ring (31), circular supporting plate (32) and positioning button (34) can be formed by a single process, as shown in FIG. 5.

As compared with the prior art polishing machine, it is understood that the present invention has the following advantages:

1. The present invention simplifies the number of components required, miniaturizes the size, reduces the production cost and promotes its utilization.
2. The present invention provides at least two polishing wheels so as to shorten the polishing time.
3. The present invention provides an easy way to change polishing wheel when it is worn and can no longer be used.
4. The present invention uses a timer to precisely control the polishing time, avoiding over-polishing which causes the optical disk to be damaged permanently.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A structure for a polishing machine of an optical disk comprising: a motor, a turntable unit integrated with a housing, at least two polishing wheels positioned on a cover which can cover said housing, and a timer, wherein said motor is fixed in said housing with a predetermined strength, said turntable unit is fixed at a front portion of a spindle of said motor, said turntable unit comprises a fixing ring, a circular supporting plate, a buffer pad, a positioning button, and a nut cover, said fixing ring is fixed at a front end of said spindle of said motor by a screw, said circular supporting plate with a predetermined strength and a soft buffer pad are positioned above said fixing ring in series by a positioning button with a screw bar at both ends, a nut cover with inverted bowl shape and screw inside is screwed on said positioning button to fix an optical disk on a buffer pad, a spindle shaft is positioned in a base of said polishing wheel, a screw bar and a screw ring are extended and positioned in a center of said spindle by tight screwing of said screw bar, said screw ring is tightly fastened to enhance fixity of said polishing wheels and make them freely rotatable, surface of one of said polishing wheels presses on data zone and covers an inner half region of said optical disk, surface of the other one of said polishing wheels covers an outer half region and said cover can cover components of said housing that can at least exchange the optical disk when opened and can fix the components when closed, said timer is connected to a power circuit of said motor in series to stop said motor when said motor is rotated for a predetermined time so as to precisely control polishing time of the optical disk.

* * * * *